US005304043A

United States Patent [19]

Shilling

[11] Patent Number: 5,304,043

[45] Date of Patent: Apr. 19, 1994

[54] MULTIPLE AXIS ROTARY COMPRESSOR

[75] Inventor: Thomas Shilling, Englewood, Colo.

[73] Assignee: AvMed Compressor Corporation, Denver, Colo.

[21] Appl. No.: 967,810

[22] Filed: Oct. 28, 1992

Related U.S. Application Data

[63] Continuation-in-part of Ser. No. 953,989, Sep. 29, 1992, abandoned.

[51] Int. Cl.[5] ..... F04B 1/22; F04B 27/08

[52] U.S. Cl. ..... 417/269; 91/500

[58] Field of Search ..... 91/500, 499; 92/57, 92/71; 417/269

[56] References Cited

U.S. PATENT DOCUMENTS

| | | | |
|---|---|---|---|
| 2,096,907 | 10/1937 | Linderman | 91/500 |
| 2,117,652 | 5/1938 | Chamier et al. | 91/500 |
| 2,146,133 | 2/1939 | Tweedale . | |
| 2,215,138 | 9/1940 | Stevens | 91/500 |
| 2,556,585 | 6/1951 | Järvinen . | |
| 2,821,932 | 2/1958 | Lucien . | |
| 2,875,701 | 3/1959 | Ebert | 91/500 |
| 2,956,845 | 10/1960 | Wahlmark . | |
| 2,968,286 | 1/1961 | Wiggermann | 91/500 |
| 3,052,098 | 9/1962 | Ebert . | |
| 3,180,275 | 4/1965 | Boulet . | |
| 3,196,801 | 7/1965 | Ifield . | |
| 3,289,604 | 12/1966 | Wahlmark . | |
| 3,434,429 | 3/1969 | Goodwin . | |
| 3,442,181 | 5/1969 | Olderaan | 91/500 X |
| 3,901,869 | 6/1976 | Droege, Sr. et al. . | |
| 3,961,868 | 6/1976 | Droege, Sr. et al. . | |
| 4,252,508 | 2/1981 | Forster | 91/499 X |
| 4,361,077 | 11/1982 | Mills . | |
| 4,859,162 | 8/1989 | Cox . | |

FOREIGN PATENT DOCUMENTS 0142487 12/1960 U.S.S.R. .

*Primary Examiner*—Richard E. Gluck
*Attorney, Agent, or Firm*—Rick Martin

[57] ABSTRACT

A new oiless air compressor and vacuum pump design features at least two synchronously rotating disks whose rotations are at intersecting angles of rotation. As each disk rotates, it carries at least one piston or cylinder alternatively to and from its mate. Therefore, a moving piston in a cylinder is used to compress the air. The resultant compressor ideally configured has two pair of six each centrally mounted opposing pistons. It can output 120 p.s.i.g. for 50,000 hours.

25 Claims, 6 Drawing Sheets

MULTIPLE AXIS ROTARY COMPRESSOR

This is a continuation of application Ser. No. 07/953989 filed Sept. 29, 1992, now abandoned.

FIELD OF THE INVENTION

The present invention relates to an air compressor having synchronously rotating disks (also called rotating housings) at different axes, each disk having a piston or consisting of a cylinder housing.

BACKGROUND OF THE INVENTION

Two basic oil-less types of air compressors are known. They are the rotary vane and the wobl. Below follows a summary of modern versions of these compressor types and their drawbacks.

U.S. Pat. No. 4,859,162 (1989) to Cox discloses an improved rotary vane compressor. Materials engineering improvements include a cast iron rotor housing and rotor, and a plastic liner in the housing. However, high heat in the resultant compressed air is still a basic design flaw to this type of compressor. Additional disadvantages include a maximum running life of approximately 8,000 hours, heavy-weight, dust in the output air, noise, high power consumption, and low 15 p.s.i. output.

U S. Pat. No. 3,961,868 (1976) to Droege, Sr. et al. discloses a wobl type compressor having a traditional flexible piston head. The improvement comprises a Teflon disk, an aluminum cylinder wall having an anodic coating, and an absence of lubrication. However, traditional drawbacks of a basic wobl design include shaking, noise, heavy weight, heat, large size, 7–9000 hours useful life and low 15 p.s.i. output.

U.S. Pat. No. 3,961,869 (1976) to Droege, Sr. et al. improves upon the above noted-patent with a cylinder head and O-ring.

The present invention provides vastly improved operating characteristics for a compressor. The useful life exceeds 50,000 hours for a 1–50 Standard Cubic Feet per Minute volumetric output in the 10 p.s.i. to 120 p.s.i. gauge pressure output range.

To envision the invention take two quarters (circular disks) and tilt them against one another. As you rotate them simultaneously and at different planes of rotation, you will notice that any two adjacent points move in an oscillatory motion toward and away from one another. Therefore, if one quarter holds a piston and the other quarter holds a cylinder, then you have an oscillating piston in a cylinder. Add valves and you have a compressor. Further efficiencies are gained when a third synchronously rotating disk is added at the same off axis angle as the first two disks. The central disk holds opposing pistons, thereby counter balancing vibration forces from each piston. The outer disks consist of cylinder housings. A maximum weight and size efficiency is achieved with a pair of six cylinder outer housings and a central disk having twelve pistons, six each facing toward its matching cylinder.

The above described principles have been used in high pressure hydraulic compressors and motors. They have come to be known as axial piston devices. The hydraulic axial piston devices noted below are all encased in pressure resistant housings, are all internally rotated through their central axes, and are all low speed, high pressure, small cylinder devices. They are not suited for a high speed, low pressure, large cylinder design needed for gas (air) compressors.

Below follows a summary of the hydraulic axial piston device prior art.

U.S. Pat. No. 2,875,701 (1959) to Ebert discloses a hydrostatic piston engine (used as a pump or a motor) using the concept of axially arranged pistons. These pistons rotate off axis with respect to axially arranged cylinders. The improvement consists of using interconnected chambers between the opposing pistons as pressure equalizing devices. FIG. 1 teaches the axial limit of the cylinder housings' axes are located above the axial piston housing central axis. This design feature is used in the present invention. This design feature allows for large pistons and corresponding high volume compressor outputs. Ebert, however, does not utilize this design feature to provide for large diameter pistons and cylinders. Large diameter pistons and cylinders are essential for gas compressors. This particular design feature represents the closest known prior art.

U.S. Pat. No. 3,052,098 (1962) to Ebert discloses an infinitely variable torque transmission having a series of axially offset piston/cylinder units including at least one pump and at least two motors.

U.S. Pat. No. 3,434,429 (1969) to Goodwin discloses a hydraulic pump of the axial piston type. A first cylinder block is rotated by a drive shaft. The first cylinder block turns a drive shaft which turns a second cylinder block having a non parallel housing of axial rotation. Opposing pistons are rotating synchronously between the two cylinder blocks, thereby forming a pumping action by moving in the cylinders which are housed in the cylinder blocks. There exists a passage extending axially through each of the piston rods allowing fluid passage to and from the opposing cylinders.

U.S. Pat. No. 4,361,177 (1982) to Mills discloses an axial piston type variable positive displacement fluid motor/pump. The piston rods are double ended and held axially stationary with respect to the main shaft. The cylinder barrels have a variable axis of rotation enabling a variable torque output. Further, distinct high pressure and low pressure chambers are used.

U.S. Pat. No. 2,821,932 (1958) to Lucien discloses a swash plate fluid pressure pump. The fluid pressure pump (or motor) comprises a casing having inlet and outlet ports. Parallel cylinders have pistons movable in the cylinders. A rotatable plate has on one side a planar surface perpendicular to the driving shaft and, on the other side, an inclined surface. Rotating the rotatable plate moves the pistons in the cylinders.

U.S. Pat. No. 2,956,845 (1960) to Wahlmark discloses a hydraulic device with a swash plate comprising piston members with a spherically surfaced member.

U.S. Pat. No. 3,289,604 (1966) to Wahlmark discloses a hydraulic device with a swash plate. Both axial and radial loading to the plate are absorbed with a drive shaft overhang arrangement.

U.S. Pat. No. 3,180,275 (1965) to Boulet discloses a hydraulic engine of the rotary barrel type. Each piston has movement parallel to a driving shaft for cylindrical movement.

U.S. Pat. No. 3,196,801 (1965) to Ifield discloses a hydraulic liquid axial piston pump (or motor) with an adjustable inclined plate for providing variable displacement. The piston assembly rotates on a universal joint. The rotating cylinder plate is adjustably movable.

U.S. Pat. No. 2,146,133 (1939) to Tweedale discloses a fluid pressure power transmission having a series of piston/cylinder units at an angle moving with a rotary plate.

U.S. Pat. No. 2,556,585 (1951) to Jarvinen discloses an internal combustion motor with a cylinder arranged concentrically about and parallel with the driveshaft. The motor is lubricated and cooled by fluids.

Russian 142,487 (1960) to Tyarason discloses an axial piston pump for fluids differing in the fact that bent pipes and tie rods relieve tensile forces, and torroidal chambers reduce inertia.

The present invention improves upon the prior art by providing a free standing, caseless, set of rotating cylinder housings and a central rotating piston disk. A stationary mounting spindle passes through the spin axes of all three of the aforementioned rotating disk and housings. This design also incorporates raising the axial limit of the rotating cylinder housings above the central axis of the rotating piston disk. This design allows large pistons to be mounted on the rotating piston disk and likewise allows large cylinders to be contained within the rotating cylinder housings. The stationary mounting spindle absorbs the central thrust vector and all the corresponding compression forces.

The spin rotation is provided exteriorly on the periphery of the rotating piston disk. Spin rotation is synchronously transmitted to the adjacent rotating cylinder housings by means of gears. The resultant design enables an oil-less 1700 rpm air compressor to provide 120 p.s.i. in excess of 50,000 hours.

SUMMARY OF THE INVENTION

The main object of the present invention is to provide an oil less air compressor having only rotating members and low piston to cylinder friction. The rotating members must be synchronously rotating at different axial angles.

Another object of the present invention is to provide three rotating components. The central rotating piston disk thus has opposed pistons to counter balance compression forces.

Another object of the present invention is to provide the above objects in a freestanding caseless design having a stationary mounting spindle passing through the spin axes of the rotating members, and peripheral drive means, thus enabling high rotational speed and the absorption of compression forces.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1A:
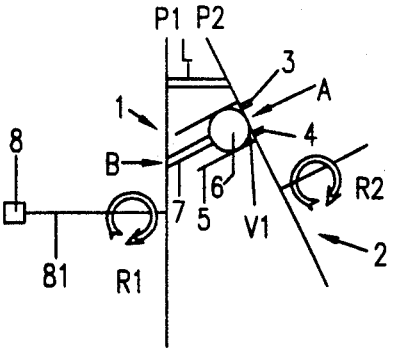
FIGS. 1 (*a*) (*b*) (*c*) show a time sequence diagram of a single piston embodiment of the present invention.
Figure 1B:
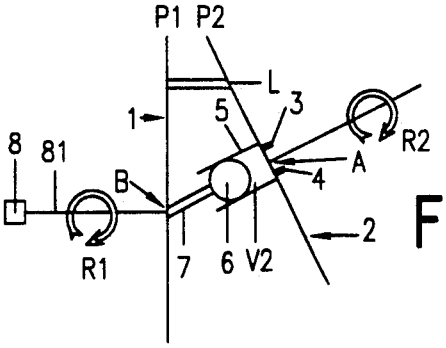
Figure 1C:
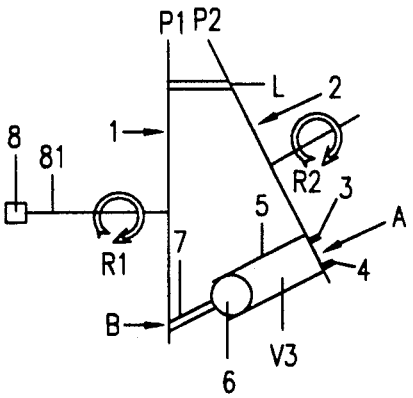

Referring first to FIG. 1(*a*), a rotating disk 1 rotates in direction $R_1$ in plane $P_1$. A second rotating disk 2 rotates in direction $R_2$ in plane $P_2$ synchronously with first rotating disk 1. Planes $P_1$, $P_2$ must not be parallel.

A piston 6 is mounted to first rotating disk 1 by means of a connecting rod 7. A cylinder 5 is mounted to second rotating disk 2. Cylinder 5 has a one way inlet valve 3 and a one way exhaust valve 4.

In FIG. 1(*a*), point B on the first rotating disk 1 is at its nearest distance to point A on second rotating disk 2. Piston 6 is fully extended into cylinder 5, thereby compressing maximally volume $V_1$ and forcing compressed air out of exhaust valve 4.

In FIG. 1(*b*) points B, A are at their midpoint distance, and piston 6 is in a downstroke, thereby causing a vacuum in volume $V_2$ and subsequently pulling intake air through inlet valve 3. In FIG. 1(*c*) points B, A are maximally separated, piston 6 is about to begin a compression stroke, and volume $V_3$ is at maximum capacity with intake air.

Motor 8 turns drive shaft 81 thereby rotating first rotating disk 1. Linkage L synchronously rotates second rotating disk 2. Linkage L is generally comprised of a worm gear well known in the art.

Planes $P_1$, $P_2$ can never be parallel. When extended they must form an intersection. This enables distances A, B to vary.

Figure 2A:
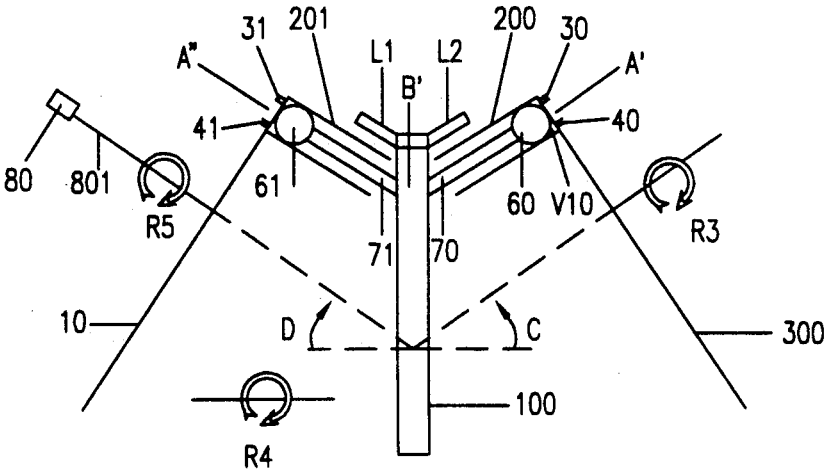
FIGS. 2 (*a*) (*b*) (*c*) show a time sequence diagram of a dual piston embodiment of the present invention.
Figure 2B:
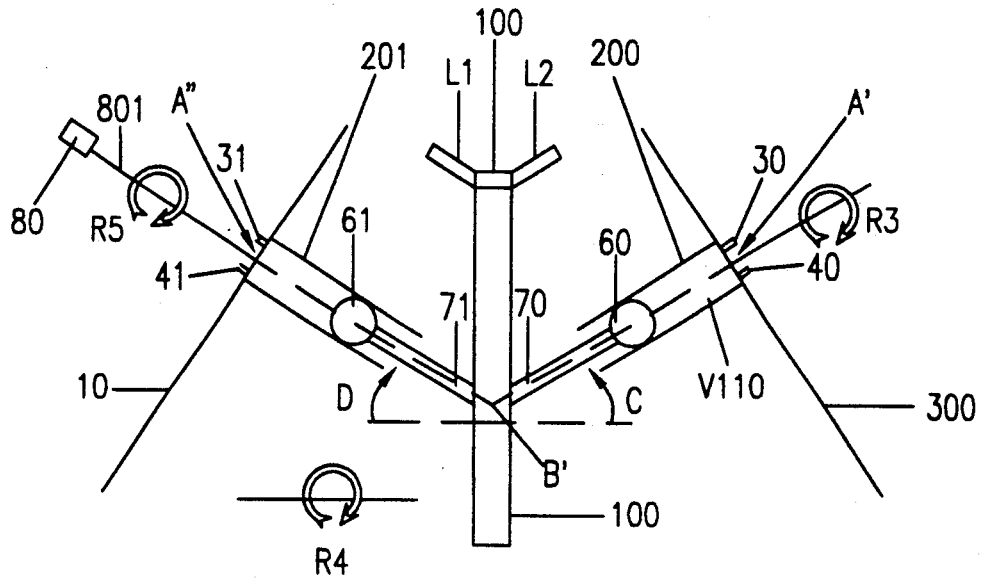
Figure 2C:
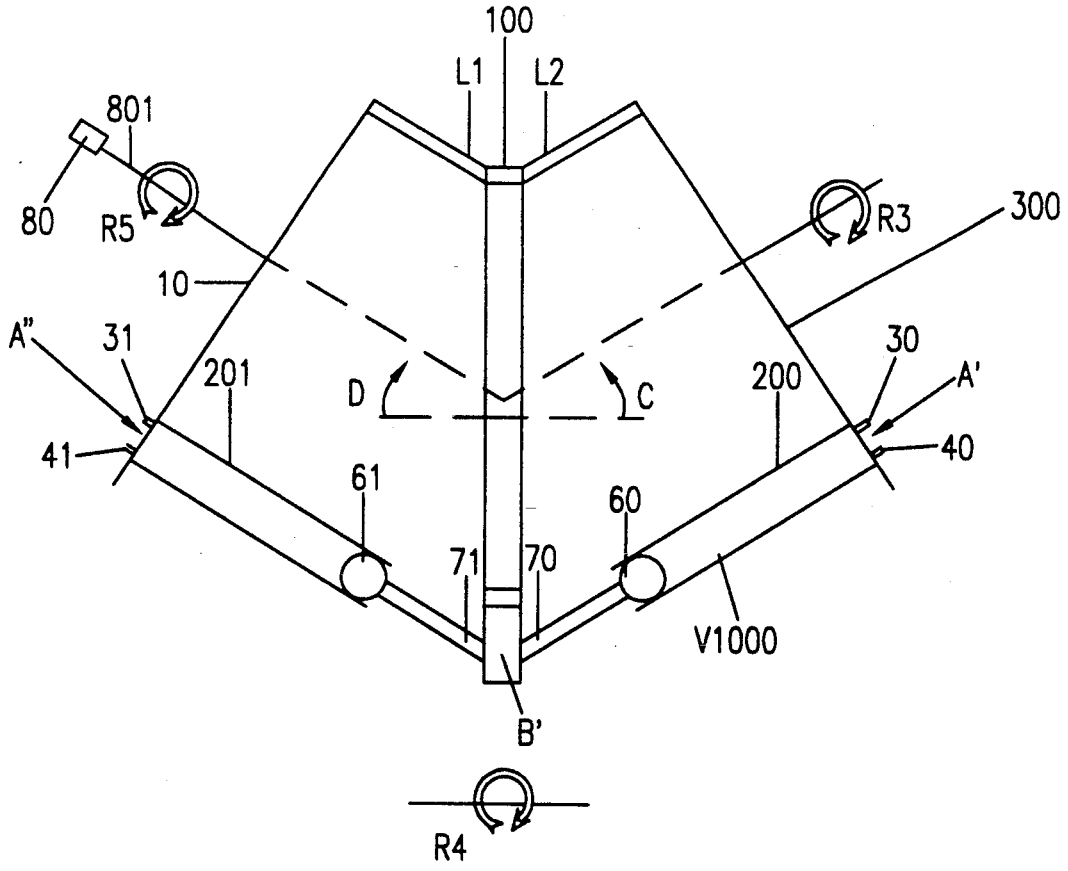

Referring next to FIGS. 2 (*a*) (*b*) (*c*), a motor 80 turns drive shaft 801 thus rotating first rotating disk 10 in direction $R_5$. Linkage $L_1$ synchronously rotates second rotating disk 100 in direction $R_4$ which, by means of linkage $L_2$, synchronously rotates third rotating disk 300 in direction $R_3$. Angles C, D are equal and always greater than zero degrees but never equal to or greater than 90 degrees. Therefore the distance between points A''—B' and B'—A' varies in unison during the rotation of rotating disks 10, 100, 300.

Pistons 60, 61 mounted on connecting rods 70, 71 move inside cylinders 200, 201 the same as in FIGS. 1(*a*) (*b*) (*c*). However, pistons 60, 61 now compensate for each other's compression forces, thereby creating a low noise, low vibration system. Input valves 30, 31 and output valves 40, 41 cooperate as in FIGS. 1(*a–c*) above.

Volume $V_{10}$ is compressed. Volume $V_{110}$ is expanding, thereby creating a vacuum and causing the intake of air through inlet valve 30. Volume $V_{1000}$ is maximal, and the air inside is ready to be compressed.

Figure 3:
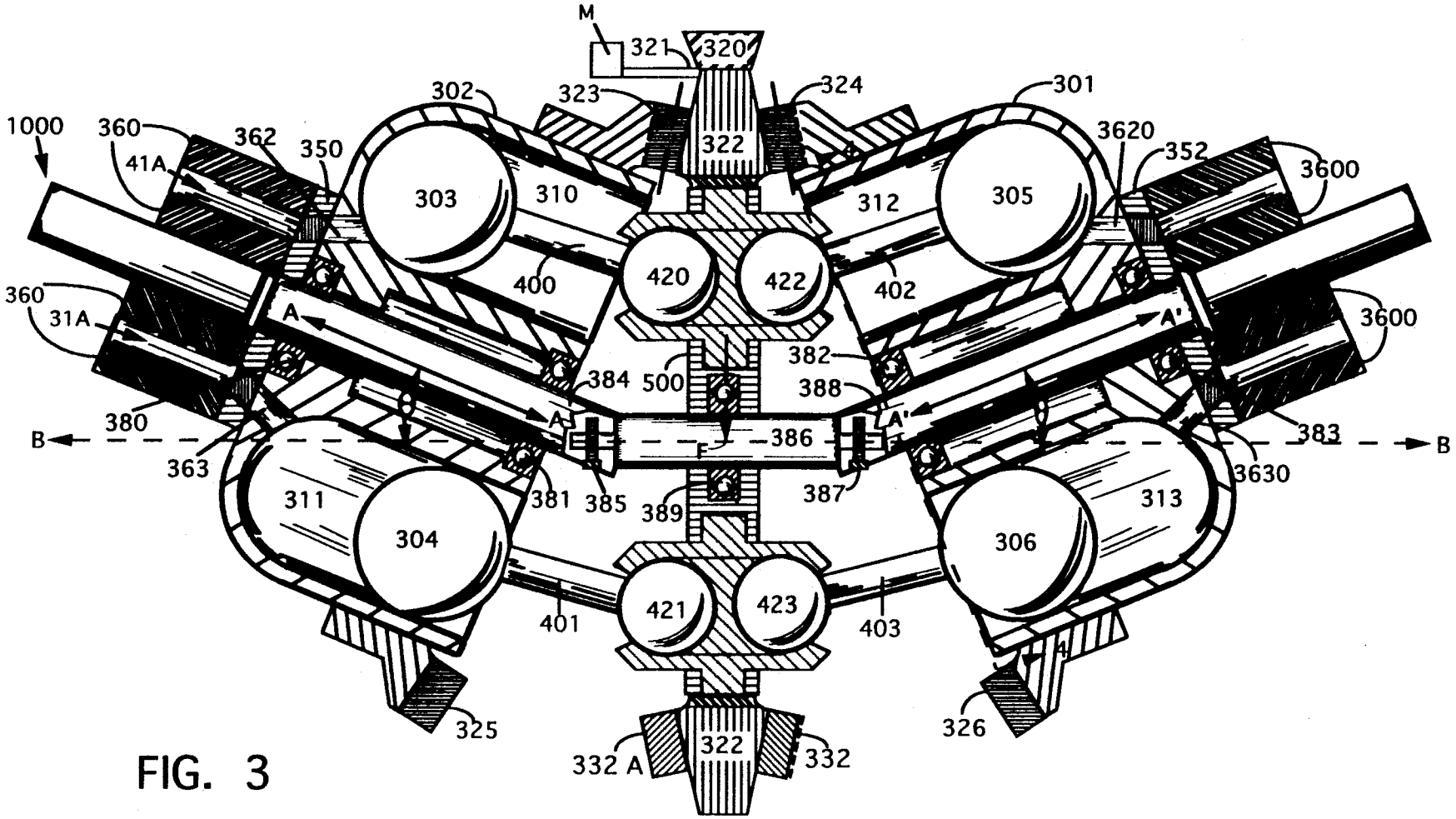
FIG. 3 is a front sectional view of a twelve cylinder axial piston air compressor.
Figure 4:
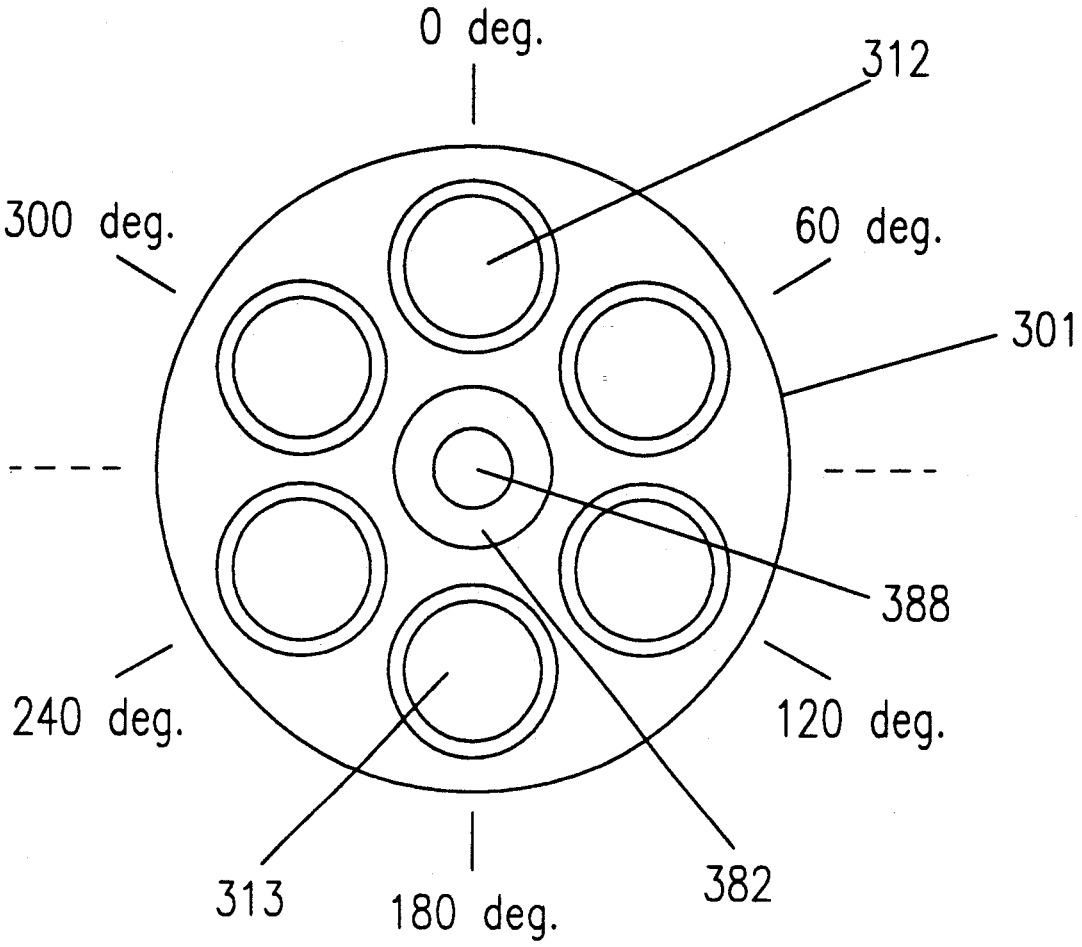
FIG. 4 is a front plan view of a rotating cylinder housing taken along line 4—4 of FIG. 3.
Figure 9:
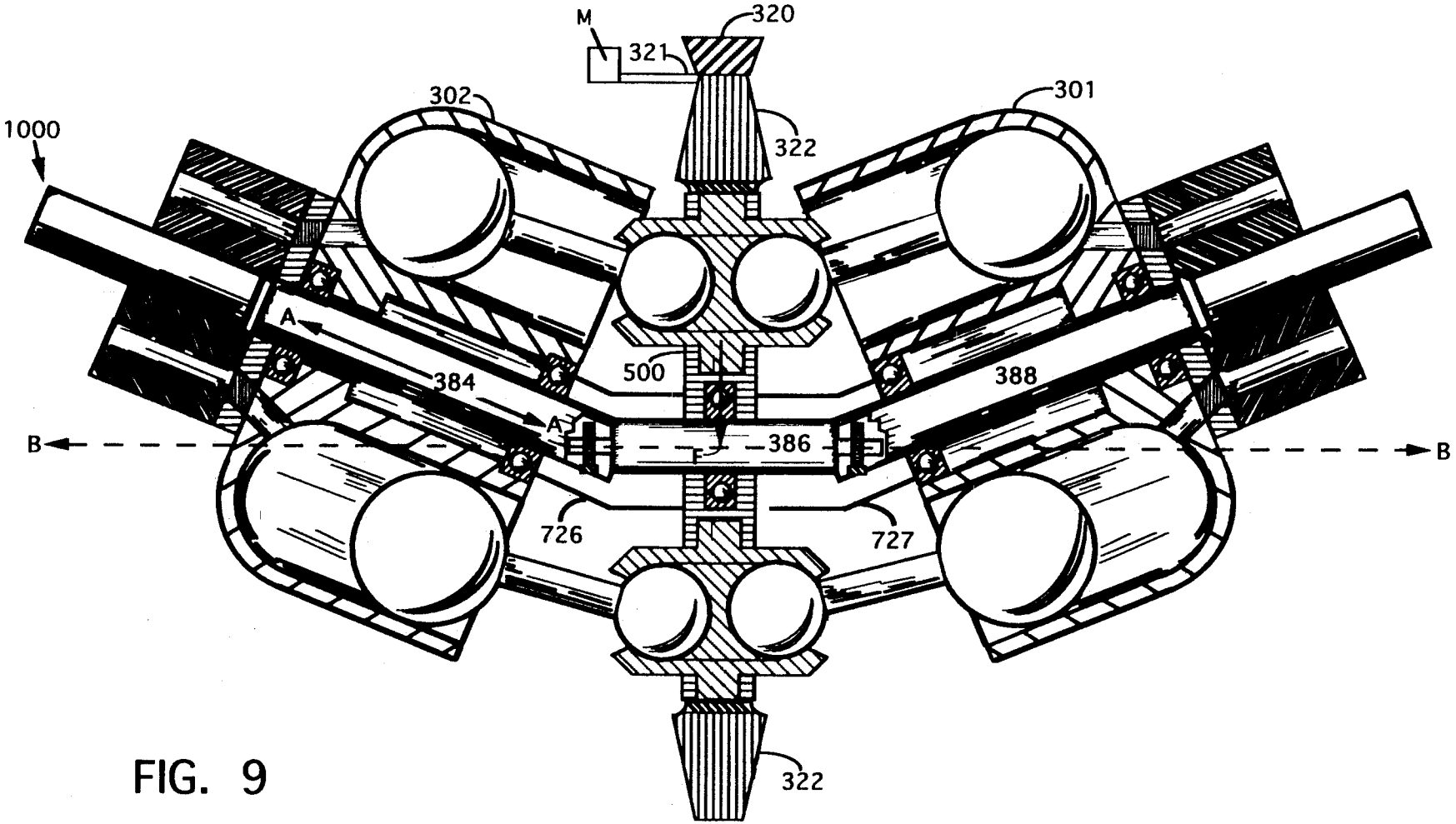
FIG. 9 is a front sectional view of an alternative embodiment of a twelve cylinder axial piston air compressor.

The maximally efficient embodiment for the present invention is achieved with a twin 'six-shooter' design as shown in FIGS. 3,4,9. The central rotating piston disk 500 has two pair of six opposing pistons 303, 304, 305, 306, etc. Each rotating cylinder housing 301, 302, contains six cylinders 310, 311, 312, 313, etc.

A drive shaft 321 (powered by a motor M) turns a driving gear 320. Driving gear 320 in turn drives the peripheral gear 322 fastened to the outer rim of the rotating piston disk 500.

The peripheral gear 322 has bevel gear teeth 323, 324, 332, 332A which mesh with teeth 325, 326 and thereby rotate rotating cylinder housings 301, 302. In the below description only four of the twelve cylinders are shown, and the term "etc." is used to include identical parts not shown.

Stationary manifolds 360, 3600 communicate to all twelve cylinders 310, 311, 312, 313, etc. by means of twelve revolving cylinder ports 362, 363, 3620, 3630, etc. Revolving cylinder ports 362, 363, 3620, 3630, etc. are revolving around the cylinder spindles 388, 384. Two stationary control valve disks 350 and 352 provide input and output timing as well as a sliding surface between the stationary manifolds 360 and 3600 and the rotating cylinder housings 302, 301.

The functions of input and output as described as input valves 30, 31 and output valves 40, 41 in FIG. 2(*a*) are described below for the device shown in FIG. 3.

Figure 6:
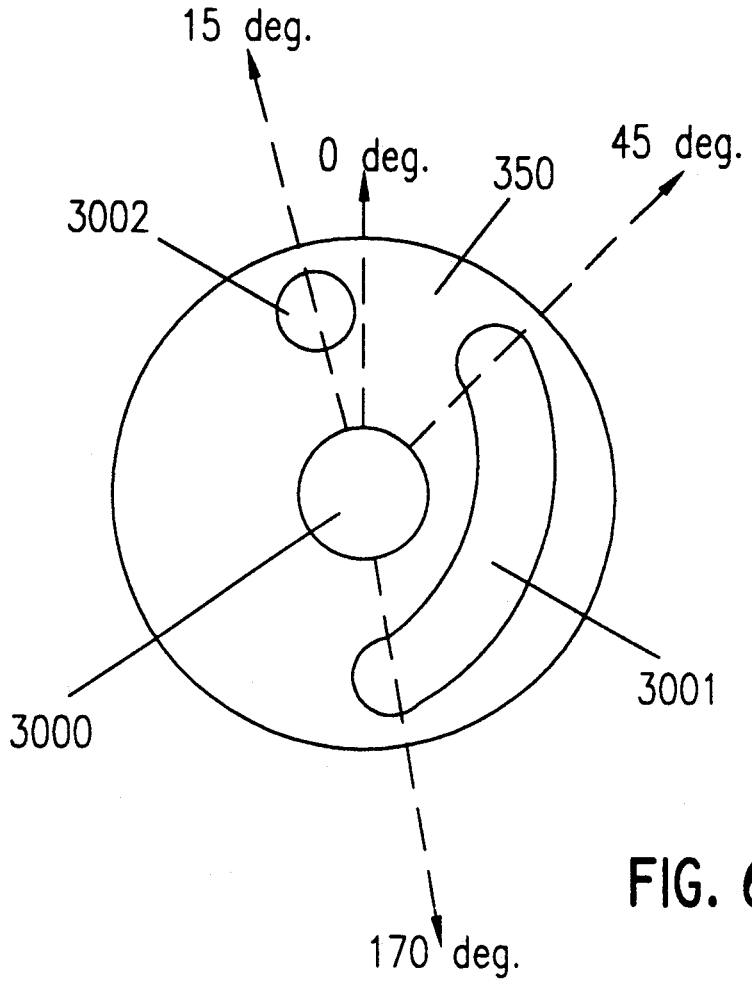
FIG. 6 is a front plan view of control valve disk 350 of FIG. 3.

Referring next to FIGS. 6, 3 the control valve disk 350 is shown mounted in a stationary fashion between the stationary manifold 360 and the rotating cylinder housing 302. In FIG. 3 the piston 304 has moved downward in cylinder 311 during the intake cycle. The revolving cylinder port 363 has moved from angle 45 deg. to angle 170 deg. while communicating with stationary valve inlet port 31A (part of stationary manifold 360) by means of inlet slot 3001.

In a similar manner the piston 303 in cylinder 310 is in the position of exhausting compressed air in the final stages of the exhaust cycle. The compressed exhaust air is traveling out revolving cylinder port 362, through the stationary valve exhaust port 41A (part of stationary manifold 360) by means of output slot 3002 as shown in FIG. 6.

Pistons 303, 305 are in the exhaust position. Pistons 304, 306 are completing the intake cycle.

Rotating cylinder housings 301, 302 and axial piston rotating disk 500 are all supported by and rotate around stationary spindle 1000. Stationary spindle assembly 1000 is further comprised of axial piston spindle 386, and cylinder spindles 384, 388. Each spindle 386, 384, and 388 has a central axis. The cylinder spindle 388 is opposing cylinder spindle 384. Bearings 380, 381 support rotating cylinder housing 302. Design choices (not shown) would replace stationary spindle 1000 with a driving shaft.

Rotating piston disk 500 and rotating cylinder housings 301 and 302 are preferably of the same diameter, thereby easily synchronized by peripheral gears of the same diameter.

Bolt 385 connects cylinder spindle 384 to axial piston spindle 386 having bearing 389 which rotatably supports rotating piston disk 500. Bolt 387 connects axial piston spindle 386 to cylinder spindle 388. Bearings 382, 383 rotatably support rotating cylinder housing 301.

The axial limit A—A of rotating cylinder housing 302 lies entirely above the central axis B—B of axial piston rotating disk 500. The larger the intersecting angle between A—A and B—B, Θ (the intersecting angle between the central axis of axial piston spindle 386 and the central axis of cylinder spindle 384), the larger the available displacement of all cylinders. Correspondingly the greater the capability to provide increased volume and pressure. The preferred embodiment of the present invention uses approximately a 25 degree angle for Θ. This design enables all twelve cylinders 310, 311, 312, 313 etc. to have relatively large volumes as compared to the known art of hydraulic axial piston compressors which place A—A in an intersecting alignment with B—B.

The present invention's placement of A—A over B—B also creates a force vector F on rotating piston disk 500. Force vector F is absorbed by axial piston spindle 386. Piston force vectors may also occur due to faulty valving, and such vectors are also absorbed by cylinder spindles 384, 388. This design eliminates the need for a force absorbing case having a central rotating spindle and a heavy external bearing means, the known hydraulic axial piston device art.

Figure 8:
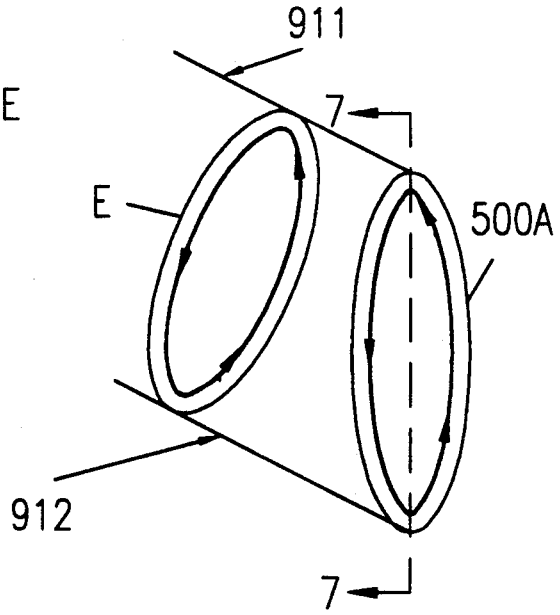
FIG. 8 is a front plan view of the air compressor's motion of operation, the same view as in FIG. 3.

The pistons 303, 304, 305, 306, etc. have connecting rods 400, 401, 402, 403, etc. which are mounted in swivel joints 420, 421, 422, 423 etc. FIG. 8 shows how piston assemblies 911, 912 travel in a pattern where the swivel joints (analogous to 420) travel in circle 500A. The distal ends of the pistons (analogous to 303) travel in ellipse E due to the angular offset of A—A over B—B as shown in FIG. 3.

Design choices (not shown) for the above invention include a dry lube surface and a high coefficient of thermal conductivity for the walls of all cylinders, low mass for all connecting rods and piston heads, and a steel stationary spindle 1000. Cooling fins may be added to rotating cylinder housings 301, 302.

Design choices for valving (not shown) include the replacement of all control valve disks with output check valves at the cylinder heads. Input valves at the cylinder sides or through hollow connecting rods could also be used.

Design choices (not shown) for peripherally driving the rotating components include applying torque to either outer rotating cylinder housing. The torque is transferred to the other two rotating components by means of a central synchronizing gear.

Referring next to FIG. 4 rotating cylinder housing 301 is seen to have cylinders 312, 313 and four identical cylinders. This assembly is rotatably supported by cylinder spindle 388 having bearings 382 and 383 (FIG. 3).

Figure 5:
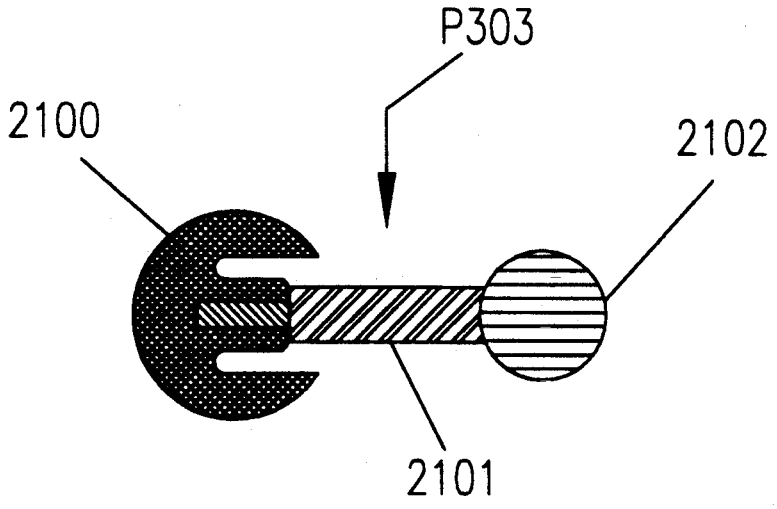
FIG. 5 is a longitudinal sectional view of one embodiment of a piston which could be used in the device shown in FIG. 3.

Referring next to FIG. 5 a generic piston assembly P303 has a polyimide spherical piston head 2100, an aluminum connecting rod 2101, and a spherical base 2102. Design choices (not shown) would include cylindrical piston heads with or without piston rings.

Referring next to FIG. 6 a generic control valve disk 350 has a central mounting hole 3000. The input stroke slot 3001 provides a relatively long duration of ambient gas pressure input, while the output slot 3002 provides a high pressure relatively short duration output. Design choice for the control valve disk 350 would include a polyimide material.

Figure 7:
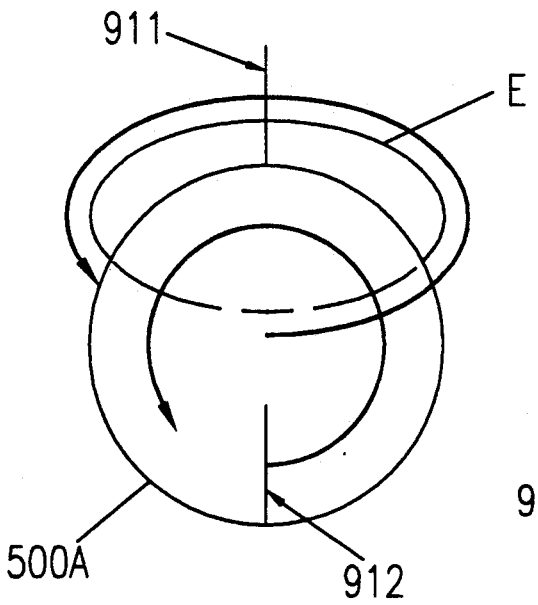
FIG. 7 is a central axial view of the air compressor's motion of operation as taken from FIG. 3 along line B—B. The view is shown as line 7—7 of FIG. 8.

Referring next to FIGS. 7, 8 the motions of the piston assemblies 911, 912 are shown. These motions occur in any device similar in design to FIGS. 1(*a–c*), 2(*a–c*), 3, 9. The view in FIG. 7 is taken from line 7—7 in FIG. 8.

FIG. 7 shows a view taken from the exterior of a rotating cylinder housing and at the proximal end of the central axis of rotation of the rotating piston disk. This view would be along line B—B of FIG. 3. The circle 500A in FIGS. 7,8 is equivalent to the rotational motion of rotating piston disk 500 in FIG. 3. Therefore, the proximal end (the spherical base 2102 of FIG. 5) of a piston assembly travels in a circular path.

The distal end of piston assemblies 911,912 (the piston head 2100 of FIG. 5) travel in an ellipse E.

Cylinders (as in 310, 311, 312, 313 of FIG. 3) are rigidly incorporated within their respective rotating cylinder housings 301, 302. The cylinders are constrained to take a circular path revolving about the rotating cylinder housing axis of rotation.

The distal end of piston assemblies 911, 912 of FIGS. 7,8 are constrained to take elliptical path E. This motion is equivalent to the motion of pistons 303, 304, 305, 306 of FIG. 3 about central axis B—B. Additionally the motion of pistons 303, 304, 305, 306 take an elliptical path around the central axis A—A of rotating cylinder housings 301, 302.

It is, therefore, known in the art that the relative motion of the pistons 303, 304, 305, 306 with respect to their cylinders is a result of relative revolving motions only. This axial piston art does not use any reciprocating motions at all.

In an alternative embodiment as shown in FIG. 9, the means for torque transfer amongst all the rotating components 500, 301, 302 consists of a universal joint assembly 725.

Universal joint assembly 725 further comprises joint members 726, 727 which rotate with their respective rotating components, thereby absorbing shocks therebetween. Joint members 726, 727 may be of several constructions including elastomeric joints, bevel gears or interdigitating tines (intermeshing prongs).

Another embodiment (not shown) uses the well known drive means of replacing stationary spindle 388 with a universal joint drive shaft driving one outboard rotating cylinder housing. The spinning torque is transferred to the other rotating components in the manners described above.

KEY

Θ: Angle between the central axis of axial piston spindle and the axial limit of rotating cylinder housing
1, 10, 100: Rotating Disks
1000: Stationary Spindle Assembly
2: Rotating Disk
200, 201: Cylinders
2100: Piston Head
2101: Connecting Rod
2102: Connecting Rod Swivel End
3, 30: Inlet Valves
300: Rotating Disk
3000: Mounting Hole
3001: Inlet Slot
3002: Output Slot
301,302: Rotating Cylinder Housings
303,304,305,306: Pistons
31: Inlet Valve
310,311,312,313: Cylinders
31A: Valve Inlet Port
320: Driving Gear
321: Drive Shaft
322: Peripheral Gear
332, 332A, 323, 324, 325, 326: Teeth
350,352: Control Valve Disks
360,3600: Stationary Manifolds
362,363,3620,3630: Cylinder Ports
380,381,389,382,383: Bearings
385,387: Bolts
388,343: Cylinder Spindles
386: Axial Piston Spindle
4: Output Valve
41A: Valve Exhaust Port
400,401,402,403: Connecting Rods
41, 41A: Output Valves
420, 421, 422, 423: Swivel Joints
5: Cylinder
500: Rotating Piston Disk
500A: Circular Path of Motion
6, 60, 61: Pistons
7, 70, 71: Connecting Rods
7—7: Viewpoint for FIG. 7 (refer to FIG. 8)
725: Universal Joint Assembly
726,727: Joint Members
8,80: Motors
81, 801: Drive Shafts
911,912: Piston Assemblies
A—A, A'—A': Axial Limits of the Rotating Cylinder Housings
B—B: Central Axis of Axial Piston Spindle 386
C: Angle
F: Vector
D: Angle
E: Elliptical Path of Motion
L, L1, L2: Linkages
M: Motor
P1, P2: Planes of Rotation
P303: Piston Assembly
R1, R2, R3, R4, R5: Directions of Rotation
V10, V110, V1000, V1, V2, V3: Volumes Although the present invention has been described with reference to preferred embodiments, numerous modifications and variations can be made and still the result will come within the scope of the invention. No limitation with respect to the specific embodiments disclosed herein is intended or should be inferred.

I claim:

1. An axial piston gas compressor comprising:
a stationary spindle assembly;
said stationary spindle assembly further comprising an axial piston spindle having a central axis and a cylinder spindle having a central axis;
said cylinder spindle central axis obliquely disposed to said axial piston central axis;
a rotating piston disk rotatably mounted on said axial piston spindle;
a rotating cylinder housing rotatably mounted on said cylinder spindle;
said rotating cylinder housing having an axial limit disposed entirely above the central axis of the axial piston spindle;
means for synchronously rotating said rotating piston disk and said rotating cylinder housing;
said rotating piston disk having a connection means to a piston;
said rotating cylinder housing further comprising a cylinder slidingly engaged with said piston;
means for input of the gas into said cylinder; and
means for output of the gas from said cylinder.

2. The compressor of claim 1 wherein said means for synchronously rotating said rotating piston disk and said rotating cylinder housing further comprises torque means peripheral to said rotating piston disk and linkage means from said rotating piston disk to said rotating cylinder housing.

3. The compressor of claim 2 wherein said torque means further comprises a motor and a means for transmission driving said rotating piston disk, and said linkage means further comprises peripheral gear teeth on said rotating piston disk engaged in peripheral gear teeth on said rotating cylinder housing.

4. The compressor of claim 3 wherein said means for transmission further comprises a drive shaft and a driving gear.

5. The compressor of claim 1 wherein said connection means further comprises a swivel joint and a connecting rod.

6. The compressor of claim 1 wherein said stationary spindle assembly further comprises a steel construction.

7. The compressor of claim 1 wherein said means for input of the gas into said cylinder further comprises:

a stationary manifold having a stationary valve inlet port and a stationary valve exhaust port;

a stationary control valve disk having a sliding engagement with said rotating cylinder housing; and said stationary control valve disk further comprising a gas inlet slot.

8. The compressor of claim 7 wherein said means for output of the gas from the cylinder further comprises the stationary control valve disk further comprising a gas output slot.

9. The compressor of claim 1 wherein said stationary spindle further comprises:

an opposing cylinder spindle having a central axis disposed in the opposite direction in the same housing and at the same angle to the axial piston spindle as the cylinder spindle.

10. The compressor of claim 9 further comprising:

a second rotating cylinder housing rotatably mounted on the opposing cylinder spindle;

said second rotating cylinder housing having an axial limit disposed entirely above the central axis of the axial piston spindle;

means for synchronously rotating said second rotating cylinder housing with said rotating piston disk and said rotating cylinder housing;

said rotating piston disk having a connection to a second piston;

said second rotating cylinder housing further comprising a second cylinder slidingly engaged with said second piston;

means for input of the gas into said second cylinder; and means for output of the gas from said second cylinder.

11. The compressor of claim 10 wherein said means for synchronously rotating said second rotating cylinder housing further comprises linkage means from said rotating piston disk to said second rotating cylinder housing.

12. The compressor of claim 10 wherein said means for input of the gas into said second cylinder further comprises:

a second stationary manifold having a stationary valve inlet port and a stationary valve exhaust port;

a second stationary control valve disk having a sliding engagement with said second rotating cylinder housing; and said second stationary control valve disk further comprising a gas inlet slot.

13. The compressor of claim 12 wherein said means for output of the gas from said second cylinder further comprises the second stationary control valve disk further comprising a gas output slot.

14. An axial piston gas compressor comprising:

a stationary spindle assembly;

said stationary spindle assembly further comprising an axial piston spindle having a central axis and a first and second cylinder spindle each having a central axis obliquely opposed at equal angles from said axial piston spindle and co-planar with the axial piston spindle;

a rotating piston disk rotatably mounted on said axial piston spindle;

said rotating piston disk having connection means to a plurality of opposing pistons disposed distally therefrom;

a pair of rotating cylinder housings rotatably mounted on said first and second cylinder spindles;

said pair of rotating cylinder housings each further comprising a plurality of cylinders slidingly engaged with said plurality of opposing pistons;

said pair of rotating cylinder housings each having an axial limit disposed entirely above the central axis of the axial piston spindle;

means for synchronously rotating said rotating piston disk and said pair of rotating cylinder housings;

means for input of the gas into said cylinders; and means for output of the gas ,from said cylinders.

15. The compressor of claim 14 wherein said means for synchronously rotating said rotating piston disk and said pair of rotating cylinder housings further comprises torque means peripheral to said rotating piston disk and linkage means from said rotating piston disk to said pair of rotating cylinder housings.

16. The compressor of claim 14 wherein said means for synchronously rotating said rotating piston disk and said pair of rotating cylinder housings further comprises a drive shaft coincident with the central axis of the first member of the pair of rotating cylinder housings and linkage means for synchronously driving the rotating piston disk and the second member, of the pair of rotating cylinder housings.

17. The compressor of claim 16 wherein said linkage means further comprises a universal joint communicating between said rotating piston disk and said pair of rotating cylinder housings.

18. The compressor of claim 16 wherein said linkage means further comprises interdigitating tines communicating between said rotating piston disk and said pair of rotating cylinder housings.

19. The compressor of claim 14 wherein said equal angles are each approximately 25 degrees.

20. The compressor of claim 14 wherein said means for input of the gas into said cylinders further comprises:

a pair of stationary manifolds each having a stationary valve inlet port and a stationary valve exhaust port;

a pair of stationary control valve disks each having a sliding engagement with said rotating cylinder housings;

said pair of stationary control valve disks each further comprising a gas inlet slot.

21. The compressor of claim 20 wherein said means for output of the gas from the cylinders further comprises the pair of stationary control valve disks each further comprising a gas output slot.

22. The compressor of claim 14 wherein said means for synchronously rotating said rotating piston disk and said rotating cylinder housings further comprises torque means peripheral to said rotating piston disk and linkage means from said rotating piston disk to said rotating cylinder housings.

23. The compressor of claim 22 wherein said torque means further comprises a motor and a means for transmission driving said rotating piston disk, and said linkage means further comprises peripheral gear teeth on said rotating piston disk engaged in peripheral gear teeth on said rotating cylinder housings.

24. The compressor of claim 23 wherein said means for transmission further comprises a drive shaft and driving gear.

25. The compressor of claim 1 wherein said connection means further comprises a swivel joint and a connecting rod.

* * * * *